US006883244B2

(12) United States Patent
Rimback

(10) Patent No.: US 6,883,244 B2
(45) Date of Patent: Apr. 26, 2005

(54) PICTURE ALIGNMENT AND HANGING DEVICE

(75) Inventor: Peter D. Rimback, S. Euclid, OH (US)

(73) Assignee: HSN Improvements, LLC, St. Petersburg, FL (US)

( * ) Notice: Subject to any disclaimer, the term of this patent is extended or adjusted under 35 U.S.C. 154(b) by 0 days.

(21) Appl. No.: 10/425,570

(22) Filed: Apr. 29, 2003

(65) Prior Publication Data

US 2003/0229999 A1 Dec. 18, 2003

Related U.S. Application Data

(60) Provisional application No. 60/376,261, filed on Apr. 29, 2002.

(51) Int. Cl.[7] ..... G01B 5/00

(52) U.S. Cl. ..... 33/613; 33/451; 33/474

(58) Field of Search ..... 33/613, 644, 451–452, 33/465, 474, 482, 484, 429, 485, 478–479

(56) References Cited

U.S. PATENT DOCUMENTS

| | | | | | |
|---|---|---|---|---|---|
| 4,455,756 | A | * | 6/1984 | Greene | 33/613 |
| 4,485,561 | A | * | 12/1984 | Hopkins, Sr. | 33/574 |
| 4,753,014 | A | * | 6/1988 | Vrajich | 33/613 |
| 4,893,776 | A | | 1/1990 | Floyd | |
| 5,103,573 | A | | 4/1992 | Ehling et al. | |
| 5,103,574 | A | | 4/1992 | Levy | |
| 5,109,611 | A | | 5/1992 | Houck | |
| 5,129,154 | A | | 7/1992 | Aydelott | |
| 5,180,135 | A | | 1/1993 | Hindall | |
| 5,398,906 | A | | 3/1995 | Aydelott | |
| 5,471,760 | A | | 12/1995 | Farris | |
| 5,509,213 | A | | 4/1996 | Kelly et al. | |
| 5,520,318 | A | | 5/1996 | Sloop | |
| 5,867,917 | A | | 2/1999 | Karon | |
| 6,026,584 | A | * | 2/2000 | Wegman | 33/613 |
| 6,286,803 | B1 | | 9/2001 | Pellino et al. | |

* cited by examiner

*Primary Examiner*—G. Bradley Bennett
*Assistant Examiner*—Yaritza Guadalupe
(74) *Attorney, Agent, or Firm*—Thomson Hine LLP

(57) ABSTRACT

A picture alignment and hanging device for aiding in the locating and marking of positions for a hook or nail on a wall for placing a picture or mirror thereon including an elongated vertical member having an alignment hole positioned therein and an attachment end located on a bottom end thereof. The vertical member includes a hook member formed on a front portion thereof for receiving and supporting a wire or hanger attached to a picture to be hung. On the back portion of the vertical member there are formed marking element receiving recesses for receiving a marking element such as a thumbtack, push-pin, or specially designed writing implement in a secure, yet removable, fashion for marking a wall on which a picture is to be hung.

22 Claims, 4 Drawing Sheets

PICTURE ALIGNMENT AND HANGING DEVICE

CROSS REFERENCE

This application claims priority from U.S. provisional application, U.S. Ser. No. 60/376,261 filed Apr. 29, 2002, the entire contents of which are herein incorporated by reference.

BACKGROUND OF THE INVENTION

The present invention relates to a device and method to aid in hanging objects, such as pictures or mirrors. More specifically, the invention relates to a device and method for holding a picture or mirror to be hung in the appropriate place on a wall and marking positions on the wall for a hook, nail, screw, etc. for hanging the picture or mirror in the desired location.

In the past devices and methods have been provided for aiding in the alignment and hanging of pictures. For example, U.S. Pat. No. 5,180,135 to Hindall discloses a picture hanger locating device for marking a desired location on a wall for a picture. The device disclosed in the Hindall patent supports a picture and includes an alignment gauge to align a positioning arm with a vertical or horizontal line on a wall. An integral marker is provided to mark the desired location for the hook. The Hindall patent does not provide a method for hanging larger and/or heavier pictures requiring more than one hook to hold the picture on the wall.

U.S. Pat. No. 5,103,574 to Levy shows a measuring tool for hanging pictures including a box-shaped housing attached to a mechanism for ascertaining whether the housing is in horizontal and vertical alignment with respect to a wall. The tool disclosed in the Levy patent includes a level instrument, such as a bubble level, to help with the alignment process. A tape measure is built into the housing for marking linear measurements. The Levy tool, however does not include hangers from which a picture can be hung to locate a desired position for the picture on the wall.

U.S. Pat. No. 5,509,213 to Kelly et al. discloses a picture hanger aid and alignment device. The device disclosed in the Kelly et al. patent can be used to position pictures on a wall for hanging and for scribing locations on the wall where appropriate hooks should be placed. The Kelly et al. device is useful in that it can be used for pictures requiring one or two hooks. However, while the device disclosed in the Kelly et al. reference is generally useful for hanging pictures in the desired location on a wall, the Kelly et al. device is deficient in several desired qualities.

In particular, the Kelly et al. device does not provide a method or apparatus for the positioning of the picture and marking of the wall in a single step. Furthermore, the Kelly et al. device does not allow for the creation of pilot holes on the wall instead of pencil or pen marks for the location of the hooks. The Kelly et al. device does not provide an apparatus or method for the making of virtual crosshairs on a wall to pinpoint the exact location where a hook should be placed. The Kelly et al. device does not disclose a method or apparatus for marking the location for a picture to be hung underneath an already hanging picture. The Kelly et al. device does not provide a large, easy-to-hold handle for the positioning of the picture hanging device which has integral storage within the handle for the holding of picture hanging accessories such as hooks, nails, wires, etc. Finally, the device disclosed in the Kelly et al. patent is not made of only two pieces that are relatively easy to manufacture, that can be held together in tight, secure engagement (with or without an auxiliary fastener) and which may be easily disassembled when only a single piece is needed for picture hanging purposes or for storage of the picture alignment and hanging device.

Accordingly, it would be desirable to have a picture alignment and hanging device which incorporates some of the advantages of prior art picture hanging devices and improves upon the noted deficiencies of those devices.

SUMMARY OF THE INVENTION

The present invention provides a picture alignment and hanging device for aiding in the locating and marking of positions for a hook or nail on a wall for placing a picture or mirror thereon. Preferably, the device includes an elongated vertical member with an alignment hole positioned thereon. The vertical member preferably includes a handle portion formed on an upper end thereof having an integral storage unit formed therein and an attachment end located on a bottom end thereof, the attachment end preferably forming the male portion of a dovetail connection. The dovetail section may preferably include a hole formed therethrough for receiving a fastener such as a bolt or screw.

The vertical member preferably also includes a hook member, which is preferably a generally U-shaped double hook member, formed on a front portion thereof for receiving and supporting a wire or hanger attached to a picture to be hung. The vertical member preferably also includes alignment slits formed therethrough positioned adjacent to the hanging cradle or cradles of the hook member. The alignment slits are preferably formed for receiving a marking implement and are preferably aligned so that a line formed by a user through the slits points precisely at the cradles of the hook portion wherein a wire for a picture to be hung is cradled.

On the back portion of the vertical member there are preferably formed marking element receiving recesses. The marking element receiving recesses are preferably shaped to receive a marking element such as a thumbtack, push-pin, or specially designed writing implement in a secure, yet removable, fashion. The marking element receiving recesses are positioned on the back of the vertical member such that when a removable marking element is placed in the recesses in a secured position, the marking position of the marking element is directly behind the cradles of the hook member upon which a picture to be hung is supported.

The vertical member also preferably includes an auxiliary picture hanging/marking notch structure located on a bottom end thereof. The auxiliary picture hanging/marking notch structure is preferably comprised of a hook section for supporting a picture to be hung and a V-shaped notch positioned directly therebehind. The picture to be hung can be supported by the hook section using any desirable support located on the picture frame but is preferably supported by the frame itself or a saw-toothed hanger positioned on the back of the frame. The picture may also be supported by a wire attached to the picture frame. However, this method of support may, in some instances, hinder access to the marking groove depending on the location of the vertex of the wire with respect to the edge of the picture frame.

The vertical member may be used by itself to mark a location for a relatively small picture to be hung (requiring only a single hook, nail, screw, etc. for support) in the following manner. In the one step marking process, the user first places a removable marking element in the recess corresponding with the hook to be used for hanging the picture. In the case where the preferred U-shaped double hook member is being used, the user first determines which cradle of the hook member provides the best access to the vertical member for holding the vertical member during the locating procedure and places the removable marking element in the recess corresponding with that cradle. Next, the user places the hanging wire of a picture to be hung over the hook member. Finally, the user determines the best location for the picture to be hung on a wall and, once the position is finalized, presses the vertical member against the wall causing the removable marking element to mark a position on the wall where a cradle of a hook, nail, screw, etc. should be located.

In the two step marking process, the hanging wire of the picture is placed on the hook such that the alignment hole is not obscured. Next, the user positions the picture at a desired location on the wall and makes a mark in the alignment hole. The user then removes the picture from the vertical member and holds the vertical member on the wall making sure to position the previously made mark in the same position in the alignment hole. The user then makes a long mark in the alignment slit corresponding with the hook used to hold the picture. Finally, using the long mark as a guide, the position for the cradle of a hook, nail, screw, etc. on the wall can be precisely located.

The auxiliary picture hanging/marking notch structure may be used any time a relatively small picture is desired to be hung quickly and easily but it is particularly useful for marking the appropriate location for a picture that must be hung underneath a pre-existing picture or when overhead access to the desired picture hanging location is restricted. The method for marking a position for a picture to be hung using the auxiliary picture hanging/marking notch structure is as follows. First the vertical member is held in a generally upside-down orientation by a user and a picture to be hung is placed on the hook section in a support arrangement as discussed-above. Next the user locates the picture in the desired location and marks a location for a hook by placing a marking implement in the V-shaped notch thereby marking an appropriate location on the wall.

Preferably, the picture hanging device of the present invention also includes a corresponding horizontal member that may be used for aligning and locating positions for larger pictures requiring two hooks for support. The horizontal member is preferably generally elongate in shape including a female portion of a dovetail connection formed in the center thereof. In a preferred embodiment the center of the dovetail section includes a hole therethrough for receiving a fastener, such as a bolt, screw, etc. such that the vertical and horizontal members may be removably fastened to each other.

The horizontal member preferably also includes hook members formed on a front portion thereof for receiving and supporting a wire or hanger attached to a picture to be hung. The horizontal member preferably also includes vertical and horizontal alignment slits formed therethrough positioned adjacent to the hanging cradles of the hook members. The alignment slits are preferably formed for receiving a marking implement and are preferably aligned so that a line formed by a user through the slits points precisely at the cradles of the hook portion wherein a wire for a picture to be hung is cradled. Preferably, both vertical and horizontal alignment slots are provided so that "virtual cross-hairs" are created when a marking element is placed through the slits.

On the back portion of the vertical member there are preferably formed marking element receiving recesses. The marking element receiving recesses are preferably shaped to receive a marking element such as a thumbtack, push-pin, or specially designed writing implement in a secure, yet removable, fashion. The marking element receiving recesses are positioned on the back of the vertical member such that when a removable marking element is placed in the recesses in a secured position, the marking position of the marking element is directly behind the cradles of the hook members upon which a picture to be hung is supported.

The horizontal member may be used in connection with the vertical member to mark a location for a larger picture to be hung (requiring two hooks, nails, screws, etc. for support) in the following manner. First, the horizontal member is attached to vertical member by sliding the corresponding dovetail sections together to form a tight fit. If desired, a bolt or screw may then be used to further secure the vertical and horizontal members together. In the one step marking process, the user first places removable marking elements in the recesses corresponding with the hooks to be used for hanging the picture. Next, the user places the hanging wire of a picture to be hung over the hook members corresponding with the recesses where the removable marking elements have been placed. Finally, the user determines the best location for the picture to be hung on a wall and, once the position is finalized, presses the vertical member against the wall causing the removable marking elements to mark a position on the wall where the cradles of the hooks, nails, screws, etc. should be located.

In the two step marking process, the hanging wire of the picture is placed on the hook members. Next, the user positions the picture at a desired location on the wall and makes a mark in the alignment hole. The user then removes the picture from the hook members and holds the device against the wall making sure to position the previously made mark in the same position in the alignment hole. The user then makes a long mark in the alignment slits corresponding with the hook used to hold the picture. Finally, using the long marks as a guide to create a "virtual cross-hair", the position for the cradles of the hooks, nails, screws, etc. on the wall can be precisely located. If desired, a ruler can be used to continue out the marks created by the marking element thereby precisely identifying the location where the hooks, nails, screws, etc. should be located.

Other objects and advantages of the invention may be apparent to one of ordinary skill in the art upon reference to the drawings, specification and appended claims herein and are considered within the scope of the present invention.

DETAILED DESCRIPTION OF THE INVENTION

Figure 1:
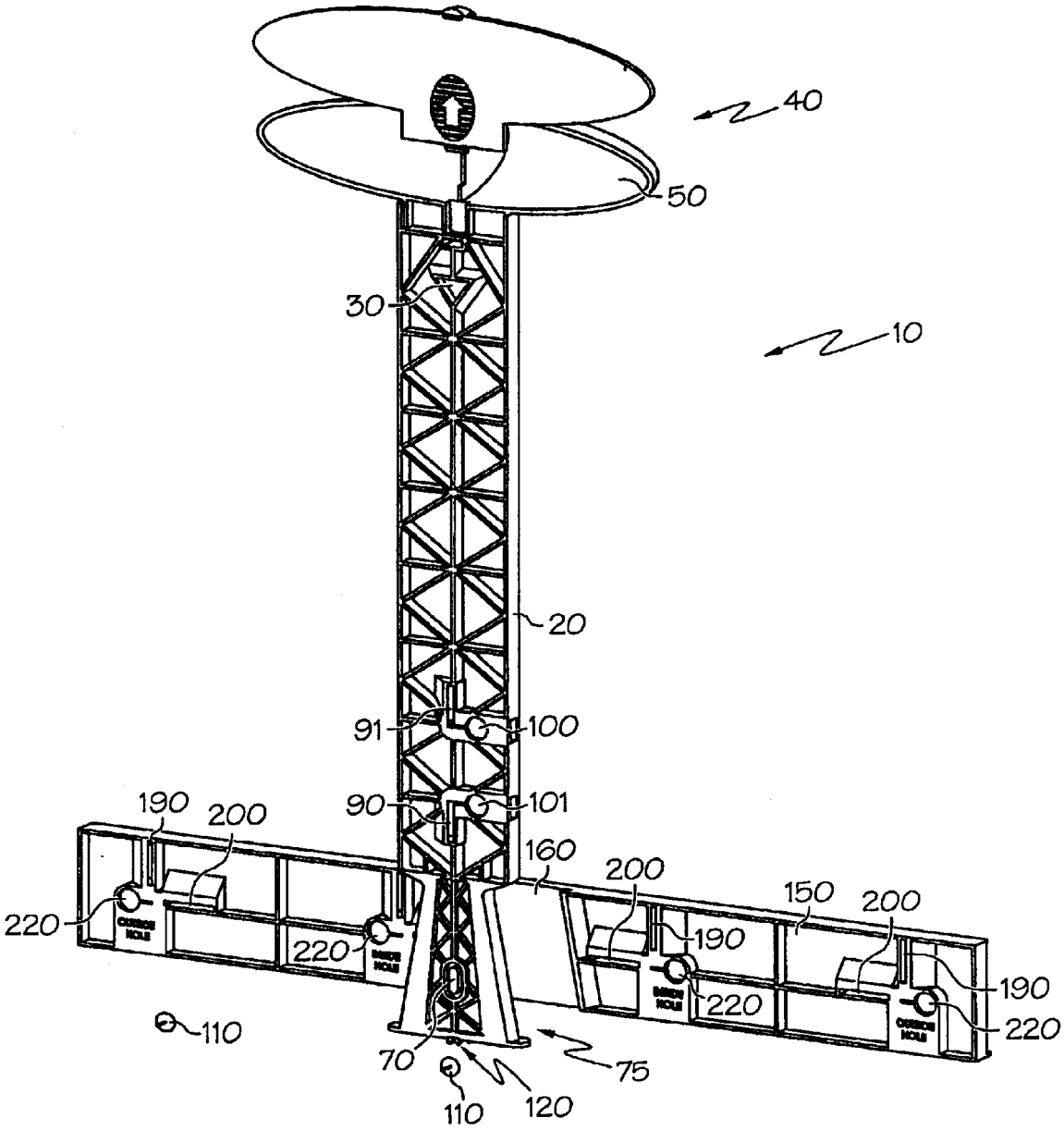
FIG. 1 illustrates a rear perspective view of the picture alignment and hanging device of the present invention.

As best seen in FIG. 1, the present invention provides a picture alignment and hanging device 10 for aiding in the locating and marking of positions for a hook or nail on a wall for placing a picture or mirror thereon. Preferably, the device includes an elongated vertical member 20 with an alignment hole 30 positioned thereon. The vertical member 20 preferably includes a handle portion 40 formed on an upper end thereof having an integral storage unit 50 formed therein and an attachment end 60 located on a bottom end thereof, the attachment end preferably forming the male portion 75 of a dovetail connecting section. The male portion 75 of the dovetail connecting section may preferably include a hole 70 formed therethrough for receiving a fastener such as a bolt or screw.

Figure 3:
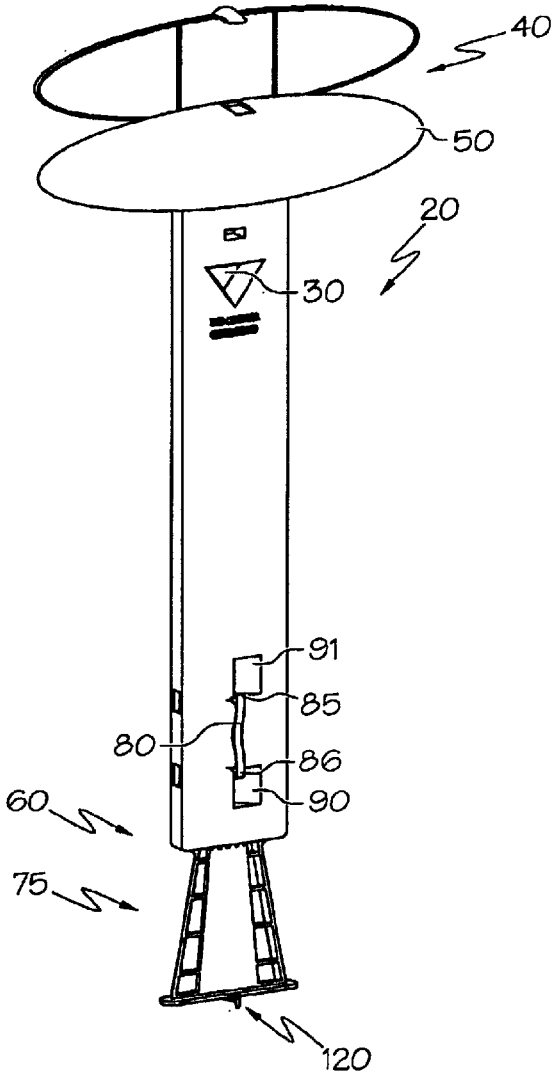
FIG. 3 illustrates a front perspective view of the picture alignment and hanging device of FIG. 1 showing only the vertical member.

As best seen in FIG. 3, the vertical member preferably also includes a hook/handle member 80, which is preferably a generally U-shaped double hook member, formed on a front portion thereof for receiving and supporting a wire or hanger attached to a picture to be hung. The double hook member 80 also preferably is usable as a handle for a user to grip onto when aligning a picture to be hung against a wall. The double hook member 80 preferably includes cradles 85, 86 on both the top and bottom portions thereof for supporting a hanging wire connected to a picture to be hung. The vertical member preferably also includes alignment slits 90, 91 formed therethrough positioned adjacent to the hanging cradles 85, 86 of the hook member 80. The alignment slits 90, 91 are preferably formed for receiving a marking implement, such as a pencil or a pen, and are preferably aligned so that a line formed by a user through the slits 90, 91 points precisely at the cradles 85, 86 of the hook member 80 wherein a wire for a picture to be hung is cradled.

Figure 2:
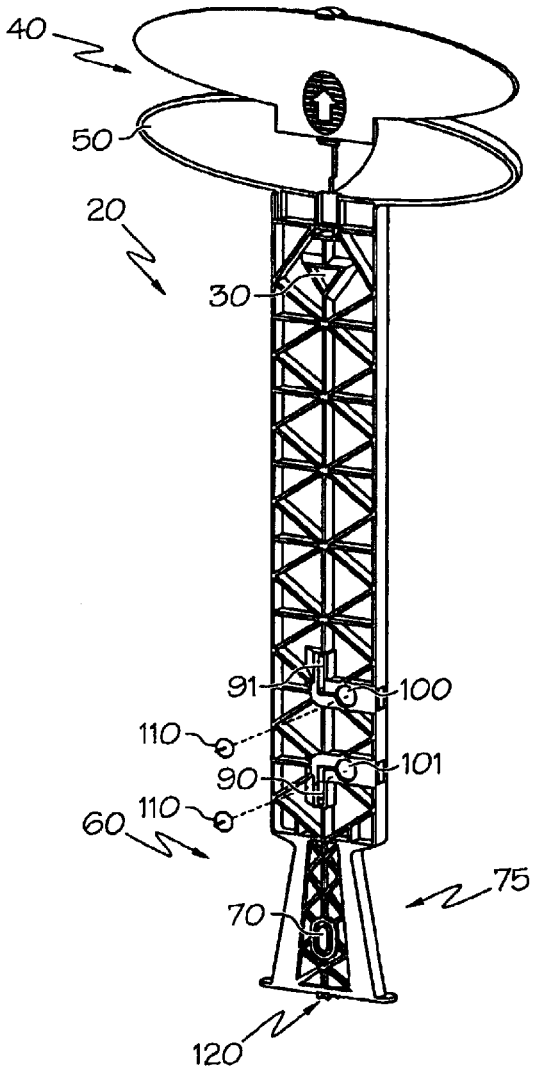
FIG. 2 illustrates a rear perspective view of the picture alignment and hanging device of FIG. 1 showing only the vertical member.

As best seen in FIG. 2, on the back portion of the vertical member 20 there are preferably formed marking element receiving recesses 100, 101. The marking element receiving recesses 100, 101 are preferably shaped to receive a marking element 110 such as a thumbtack, push-pin, or specially designed writing implement in a secure, yet removable, fashion. The marking element receiving recesses 100, 101 are positioned on the back of the vertical member 20 such that when a removable marking element 110 is placed in the recesses 100, 101 in a secured position, the marking position of the marking element 110 is located directly behind the cradles 85, 86 of the hook member 80 upon which a picture to be hung is supported.

Figure 5:
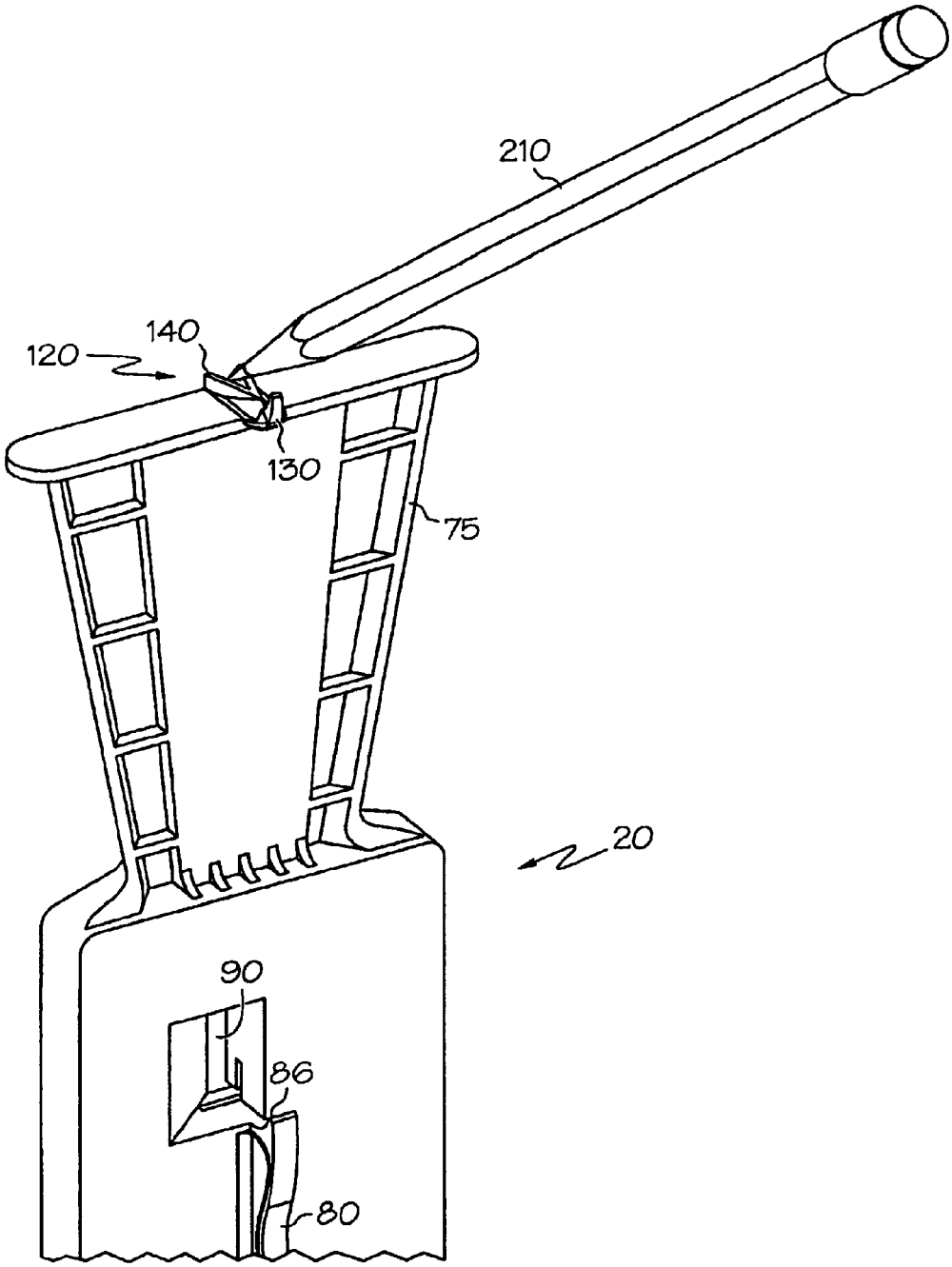
FIG. 5 illustrates a detail side perspective view of the use of the picture alignment and hanging device of the present invention to mark a hanging location for a relatively small picture.

As best seen in FIG. 5, the vertical member 20 also preferably includes an auxiliary picture hanging/marking notch structure 120 located on a bottom end thereof. The auxiliary picture hanging/marking notch structure 120 is preferably comprised of a hook section 130 for supporting a picture to be hung and a V-shaped notch 140 positioned directly therebehind. The picture to be hung can be supported by the hook section 130 using any desirable support located on the picture frame but is preferably supported by the frame itself or a saw-toothed hanger positioned on the back of the frame. The picture may also be supported by a wire attached to the picture frame. However, this method of support may, in some instances, hinder access to the V-shaped notch 140 depending on the location of the vertex of the wire with respect to the edge of the picture frame.

As best seen in FIGS. 2 and 3, the vertical member 20 may be used by itself to mark a location for a relatively small picture to be hung (requiring only a single hook, nail, screw, etc. for support) in the following manner. In the one step marking process, the user first places a removable marking element 110 in the recess 100, 101 corresponding with the hook to be used for hanging the picture. In the case where the preferred U-shaped double hook member 80 is being used, the user first determines which cradle 85, 86 of the hook member 80 provides the best access to the vertical member 20 for holding the vertical member 20 during the locating procedure and places the removable marking element 110 in the recess 100, 101 corresponding with that cradle. Next, the user places the hanging wire of a picture to be hung over the chosen hook member 80 cradle 85, 86. Finally, the user determines the best location for the picture to be hung on the wall and, once the position is finalized, presses the vertical member 20 against the wall causing the removable marking element 110 to mark a position on the wall where either the cradle of the hook or the nail, screw, etc. should be located.

In the two step marking process, the hanging wire of the picture is placed on the hook member 80 cradle 85, 86 such that the alignment hole 30 is not obscured. Next, the user positions the picture at a desired location on the wall and makes a mark in the alignment hole 30. The user then removes the picture from the vertical member 20 and holds the vertical member on the wall making sure to position the previously made mark in the same position in the alignment hole 30. The user then makes a long mark in the alignment slit 90, 91 corresponding with the cradle 85, 86 used to hold the picture during the positioning procedure. Finally, using the long mark as a guide, the position for the cradle of the hook or a nail, screw, etc. on the wall can be precisely located to hang the picture in the desired location.

As best seen in FIG. 5, the auxiliary picture hanging/marking notch structure 120 may be used any time a relatively small picture is desired to be hung quickly and easily but it is particularly useful for marking the appropriate location for a picture that must be hung underneath a pre-existing picture or when overhead access to the desired picture hanging location is restricted. The method for marking a position for a picture to be hung using the auxiliary picture hanging/marking notch structure 120 is as follows. First the vertical member 20 is held in a generally upside-down orientation by a user and a picture to be hung is placed on the hook section 130 in a support arrangement as discussed-above. Next the user locates the picture in the desired location and marks a location for a hook, screw or nail by placing a marking implement 210 in the V-shaped notch 140 thereby marking an appropriate location on the wall for the placement of the cradle of a hook, a nail, screw, etc. for the hanging of the picture.

Figure 4:
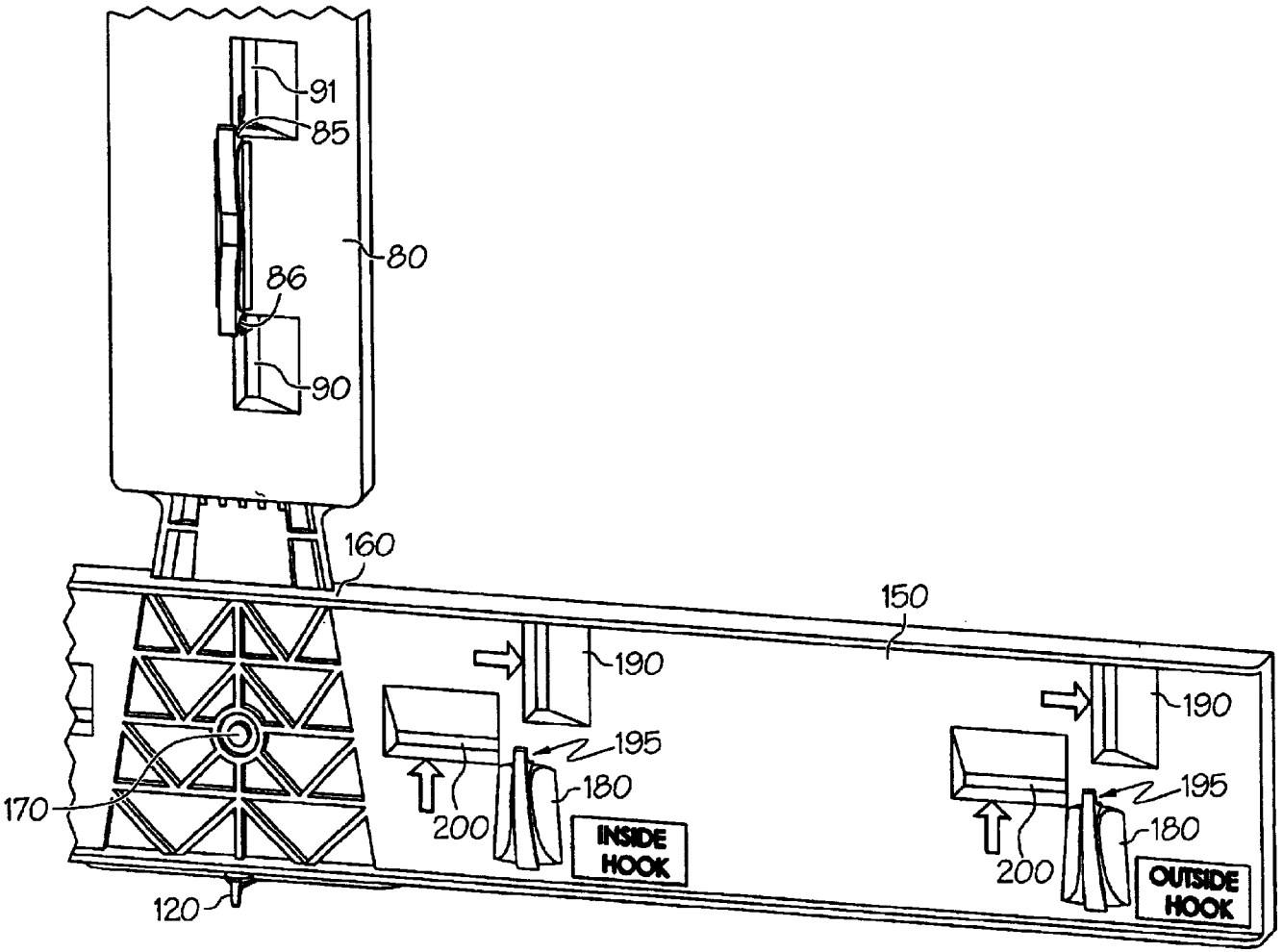
FIG. 4 illustrates a detail side perspective view of the alignment slits and hook members of the picture alignment and hanging device of FIG. 1.

As best seen in FIGS. 1 and 4, the picture hanging device of the present invention preferably also includes a corresponding horizontal member 150 that may be used for aligning and locating positions for larger pictures requiring two hooks for support. The horizontal member 150 is preferably generally elongated in shape and includes a female portion of a dovetail connection 160 formed in the center thereof. In a preferred embodiment, the center of the dovetail connection 160 includes a hole therethrough 70 for receiving a fastener, such as a bolt, screw, etc. such that the vertical 20 and horizontal 150 members may be removably fastened to each other.

As seen best in FIG. 4, the horizontal member 150 preferably also includes hook members 180 formed on a front portion thereof for receiving and supporting a wire or hanger attached to a picture to be hung. The horizontal member preferably also includes vertical 190 and horizontal 200 alignment slits formed therethrough positioned adjacent to the hanging cradles 195 of the hook members 195. The alignment slits 190, 200 are preferably formed for receiving a marking implement 210 and are preferably aligned so that a line formed by a user through the slits 190, 200 points precisely at the cradles 195 of the hook members 180 wherein a wire for a picture to be hung is cradled. Preferably, both vertical 190 and horizontal 200 alignment slits 190, 200 are provided so that "virtual cross-hairs" are created when a marking implement 210 is used to form a line through the slits 190, 200.

As best seen in FIG. 1, on the back portion of the horizontal member 150 there are preferably formed marking element 110 receiving recesses 220. The marking element 110 receiving recesses 220 are preferably shaped to receive a marking element 110 such as a thumbtack, push-pin, or specially designed writing implement in a secure, yet removable, fashion. The marking element 110 receiving recesses 220 are positioned on the back of the horizontal member 150 such that when a removable marking element 110 is placed in the recesses 220 in a secured position, the marking position of the marking element 110 is directly behind the cradles 195 of the hook members 180 upon which a picture to be hung is supported.

The horizontal member 150 may be used in connection with the vertical member 20 to mark a location for a larger picture to be hung (requiring two hooks, nails, screws, etc. for support) in the following manner. First, the horizontal member 150 is attached to vertical member 20 by sliding the corresponding dovetail sections 75, 160 together to form a tight fit. If desired, a bolt or screw (not shown) may then be used to further secure the vertical 20 and horizontal 150 members together. In the one step marking process, the user first places removable marking elements 110 in the recesses 220 corresponding with the hook members 180 to be used for hanging the picture. Next, the user places the hanging wire of a picture to be hung over the hook members 180 corresponding with the recesses 220 where the removable marking elements 110 have been placed. Finally, the user determines the best location for the picture to be hung on the wall and, once the position is finalized, presses the horizontal member 150 against the wall causing the removable marking elements 110 to mark a position on the wall where the cradle of the hook, or a nail, screw, etc. should be located.

In the two step marking process (not utilizing the removable marking elements 110), the hanging wire of the picture is placed on the hook members 180 as detailed above. Next, the user positions the picture at a desired location on the wall and makes a mark in the alignment hole 30. The user then removes the picture from the hook members 180 and holds the device against the wall making sure to position the previously made mark in the same position in the alignment hole 30. The user then makes long marks in the alignment slits 190, 200 corresponding with the hook members 180 used to hold the picture. Finally, using the long marks as a guide to create a "virtual cross-hair", the position for the cradles of the hooks or the nails, screws, etc. on the wall can be precisely located. If desired, a ruler can be used to continue out the marks created by the marking element thereby precisely identifying the location where the cradle of the hooks, or the nails, screws, etc. should be located.

In describing preferred embodiments of the present invention illustrated in the drawings, specific terminology is employed for the sake of clarity. However, it is to be understood that the invention is not intended to be limited to the specific terminology so selected, and it is to be understood that each specific element includes all technical equivalents that operate in a similar manner to accomplish a similar purpose. Additionally, it is noted that modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A picture alignment and hanging device comprising:

a member having a front side and a back side, said back side having a planar surface for positioning said member in a flat relationship against a wall, said member further comprising an attachment end located on a bottom portion of said member, said attachment end forming the male portion of a dovetail connection;

a hook member located on said front side of said member, said hook member including a cradle portion; and a recess located in the back side of said member shaped to receive a removable marking element, said recess positioned such that a marking end of a removable marking element placed therein is generally aligned with said hook member cradle, said recess being at least partially bounded by a support surface that is shaped and located to prevent said removable marking element that is placed in said recess from being passed entirely through said member.

2. The picture alignment and hanging device of claim 1 further comprising an alignment hole and an alignment slit extending through said member, said alignment slit being positioned proximal said hook member such that said slit terminates proximal said hook member cradle portion, said alignment slit further being shaped to receive a marking implement.

3. The picture alignment and hanging device of claim 1 wherein said hook member comprises a double hook member and wherein said double hook member includes cradle portions on both a top and bottom thereof.

4. The picture alignment and hanging device of claim 1 wherein said marking element receiving recess is shaped to receive a thumbtack, push-pin, or writing implement only from said back side of said vertical member.

5. The picture alignment and hanging device of claim 1 further comprising a hole through said male portion of said dovetail connection shaped to receive a fastener therethrough.

6. The picture alignment and hanging device of claim 1 further comprising an auxiliary hook member positioned on a bottom extent of said member having a notch positioned directly therebehind.

7. The picture alignment and hanging device of claim 1 wherein said hook member comprises a handle.

8. The picture alignment and hanging device of claim 1 wherein said recess extends only partially through the thickness of said member.

9. The picture alignment and hanging device of claim 1 wherein said recess is generally vertically and generally horizontally aligned with said hook member cradle.

10. A picture alignment and hanging device comprising:

a member having a front side and a back side, said back side having a planar surface for positioning said member in a flat relationship against a wall, wherein said member further comprises a handle portion formed on an upper extent thereof having an integral storage unit formed therein;

a hook member located on said front side of said member, said hook member including a cradle portion; and a recess located in the back side of said member shaped to receive a removable marking element, said recess positioned such that a marking end of a removable marking element placed therein is generally aligned with said hook member cradle, said recess being at least partially bounded by a support surface that is shaped and located to prevent said removable marking element that is placed in said recess from being passed entirely through said member.

11. A picture alignment and hanging device comprising:

a vertical member having a front side and a back side, said back side having a planar surface for positioning said vertical member in a flat relationship against a wall, wherein said vertical member further comprises:

a hook member located on said front side of said vertical member, said hook member including a cradle portion; and a recess located in the back side of said vertical member shaped to receive a removable marking element, said recess positioned such that a marking end of a removable marking element placed therein is axially aligned with said hook member cradle, wherein said vertical member further comprises a handle portion formed on an upper extent thereof having an integral storage unit formed therein;

a horizontal member having a front side and a back side, said horizontal member being shaped to be coupled to said vertical member, said back side having a planar surface for positioning said horizontal member in a flat relationship against a wall;

at least two hook members formed on said front side of said horizontal member, each hook member including a cradle portion; and a marking element receiving recess positioned behind each cradle portion of said hook members, each recess being at least partially bounded by a support surface that is shaped and located to prevent said removable marking element that is placed in the associated recess from being passed entirely through said horizontal member.

12. The picture alignment and hanging device of claim 11 wherein said marking element receiving recesses are shaped to removably receive a thumbtack, push-pin, or writing implement.

13. The picture alignment and hanging device of claim 11 wherein said vertical member includes an alignment hole and an alignment slit extending through said vertical member, said alignment slit being positioned proximal said vertical member hook member such that said slit terminates proximal said vertical member hook member cradle portion, said alignment slit further being shaped to receive a marking implement.

14. The picture alignment and hanging device of claim 11 wherein said vertical member hook member comprises a double hook member and wherein said double hook member includes cradle portions on both a top and bottom thereof.

15. The picture alignment and hanging device of claim 11 wherein said marking element receiving recesses are shaped to receive a thumbtack, push-pin, or writing implement.

16. The picture alignment and hanging device of claim 11 further comprising an attachment end located on a bottom portion of said vertical member.

17. The picture alignment and hanging device of claim 11 further comprising an auxiliary hook member positioned on a bottom extent of said vertical member having a notch positioned directly therebehind.

18. The picture alignment and hanging device of claim 11 wherein said vertical member hook member comprises a handle.

19. The picture alignment and hanging device of claim 11 further comprising at least two alignment slits formed through said horizontal member, said aligmnent slits being positioned proximal each said horizontal member hook member such that said slits terminate proximal said hook members' cradle portions, said alignment slits further being shaped to receive a marking implement.

20. The picture alignment and hanging device of claim 19 wherein said horizontal member alignment slits include at least one horizontal and at least one vertical alignment slit for each horizontal member hook member positioned on said horizontal member such that "virtual cross-hairs" may be created on a wall marking a point directly behind said horizonal member hook members' cradles using a marking implement.

21. A picture alignment and hanging device comprising:

a vertical member having a front side and a back side, said back side having a planar surface for positioning said vertical member in a flat relationship against a wall wherein said vertical member further comprises:

a hook member located on said front side of said vertical member, said hook member including a cradle portion;

a recess located in the back side of said vertical member shaped to receive a removable marking element, said recess positioned such that a marking end of a removable marking element placed therein is axially aligned with said hook member cradle, and an attachment end located on a bottom portion of said vertical member wherein said attachment end forms the male portion of a dovetail connection;

a horizontal member having a front side and a back side, said horizontal member being shaped to be coupled to said vertical member, said back side having a planar surface for positioning said horizontal member in a flat relationship against a wall;

at least two hook members formed on said front side of said horizontal member, each hook member including a cradle portion; and a marking element receiving recess positioned behind each cradle portion of said hook members, each recess being at least partially bounded by a support surface that is shaped and located to prevent said removable marking element that is placed in the associated recess from being passed entirely through said horizontal member.

22. The picture alignment and hanging device of claim 21 further comprising a hole through said male portion of said dovetail connection shaped to receive a fastener therethrough.

* * * * *

UNITED STATES PATENT AND TRADEMARK OFFICE

CERTIFICATE OF CORRECTION

PATENT NO. : 6,883,244 B2
DATED : April 26, 2005
INVENTOR(S) : Peter D. Rimback

It is certified that error appears in the above-identified patent and that said Letters Patent is hereby corrected as shown below:

Column 10,
Line 21, change "horizonal" to -- horizontal --.

Signed and Sealed this

Twelfth Day of July, 2005

JON W. DUDAS
*Director of the United States Patent and Trademark Office*